US006383351B1

(12) United States Patent
Santoyo

(10) Patent No.: US 6,383,351 B1
(45) Date of Patent: May 7, 2002

(54) ELECTRODE ASSEMBLY FOR ELECTROWINNING

(75) Inventor: Manuel G. Santoyo, Tucson, AZ (US)

(73) Assignee: Quadna, Inc., Tucson, AZ (US)

( * ) Notice: Subject to any disclaimer, the term of this patent is extended or adjusted under 35 U.S.C. 154(b) by 0 days.

(21) Appl. No.: 09/640,884

(22) Filed: Aug. 18, 2000

(51) Int. Cl.[7] ..... B23H 3/04

(52) U.S. Cl. ..... 204/286.1; 204/279; 204/281; 204/297.01

(58) Field of Search ..... 204/279, 281, 204/286.1, 297.01

(56) References Cited

U.S. PATENT DOCUMENTS 6,193,862 B1 * 2/2001 Cutmore et al. ..... 204/281

* cited by examiner

*Primary Examiner*—Bruce F. Bell
(74) *Attorney, Agent, or Firm*—Antonio R. Durando; Durando Birdwell & janke, P.L.C.

(57) ABSTRACT

An electrode assembly for the electrowinning of copper includes an electrode in the form of a plate. An edge strip is mounted on one edge of the electrode and serves to mask the edge from an electrolyte in which the assembly is immersed. A gap exists between the edge strip and the electrode on either side of the electrode. A sealing strip is located in each gap, and the sealing strips are discrete from the electrode and the edge strip. The sealing strips are resilient and can be stretched to remove the sealing strips from the gaps so that the sealing strips can be replaced.

10 Claims, 2 Drawing Sheets

ELECTRODE ASSEMBLY FOR ELECTROWINNING

BACKGROUND OF THE INVENTION

1. Field of the Invention

The invention relates to an electrode assembly for electrolytic processes.

2. Description of the Prior Art

In the electrowinning of copper, a series of anodes and cathodes are suspended side-by-side in an electrolytic bath with anodes and cathodes alternating. Copper is deposited on the major faces of the cathodes in the form of sheets, and the sheets are stripped from the cathodes once they have achieved a predetermined thickness.

The copper tends to deposit at the edges of a cathode and create bridges between the copper sheets on the opposite major faces thereof. Such bridges make stripping of the copper very difficult.

To prevent bridge formation, it has become the practice to mask or cover the edges of a cathode with strips of nonconducting material which serve as housings for the edges and the regions adjacent to the edges. Since the strips or housings are immersed in the plating solution, the solution will seep between the cathode and the strips in the absence of a barrier to such seepage. If the solution is allowed to seep into the areas between the cathode and the strips, copper will deposit in these areas and again make stripping of the copper extremely difficult.

In order to keep the plating solution from seeping between a cathode and its edge strips, sealing elements are attached to the edge strips. When the edge strips are placed on the cathode, the sealing elements bear against the cathode to form liquid-tight seals therewith.

The plating solution attacks the sealing elements so that the sealing elements deteriorate over time and lose their sealing ability. It then becomes necessary to replace the sealing elements. However, since the sealing elements are attached to the edge strips, both the sealing elements and the edge strips must be replaced. Alternatively, the worn sealing elements must be removed from the respective edge strips and new sealing elements attached to the strips. In either case, the replacement of worn sealing elements is costly.

SUMMARY OF THE INVENTION

It is an object of the invention to reduce the cost of replacing a sealing element placed between an electrode and a member which receives a portion of the electrode.

The preceding object, as well as others which will become apparent as the description proceeds, are achieved by the invention.

One aspect of the invention resides in an electrode assembly. The assembly comprises a housing, an electrode extending into the housing and defining at least one gap therewith, and a sealing element in the gap. The sealing element is discrete from the housing and the electrode.

Inasmuch as the sealing element is discrete from the housing and the electrode, it becomes possible to replace the sealing element independently of the housing and the electrode. This enables the cost of replacing the sealing element to be reduced.

An additional aspect of the invention resides in a method of manipulating an electrode assembly which includes a housing, an electrode extending into the housing and defining at least one gap therewith, and a sealing element in the gap. The method comprises the step of removing the sealing element from the gap while the electrode continues to extend into the housing.

The method may further comprise the step of inserting another sealing element in the gap following removal of the original sealing element.

Another aspect of the invention resides in a method of making an electrode assembly. This method comprises the step of inserting a portion of an electrode in a housing, and inserting a sealing element between the housing and this portion of the electrode following insertion of such portion in the housing.

Additional features and advantages of the invention will be forthcoming from the following detailed description of preferred embodiments when read in conjunction with the accompanying drawings.

DESCRIPTION OF THE PREFERRED EMBODIMENTS

Figure 1:
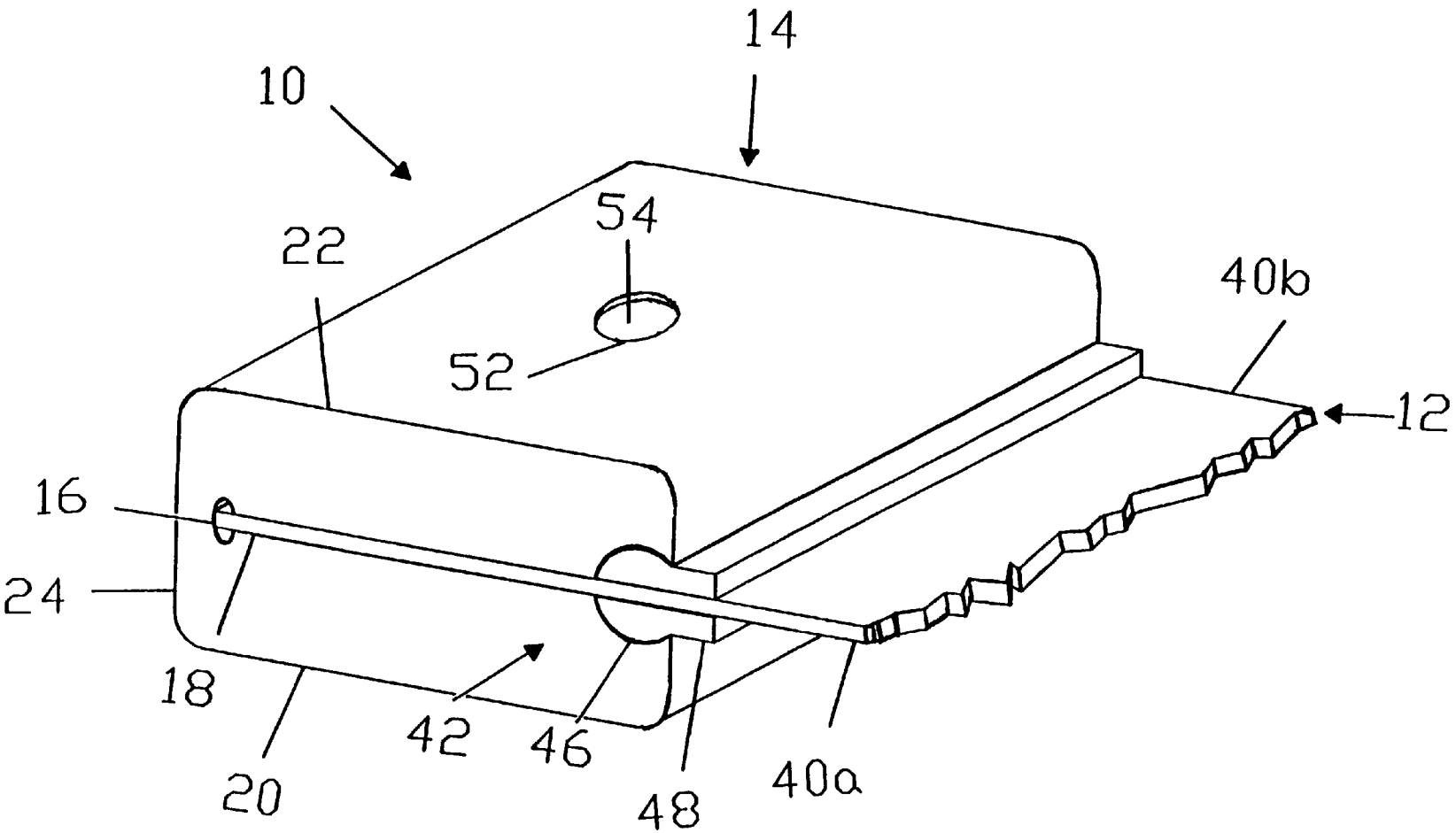
FIG. 1 is a fragmentary perspective view of an electrode assembly in accordance with the invention.

Referring to FIG. 1, an electrode assembly according to the invention is identified by the numeral 10. The electrode assembly 10 is designed for use in electrolytic processes such as, for example, the electrowinning of copper. In commercial electrolytic processes, the electrode assembly 10 may be one of a series of electrode assemblies immersed in the electrolyte of an electrolytic cell.

The electrode assembly 10 includes an electrode 12 which can be employed as a cathode. The electrode 12 is mounted in at least one housing or holder 14 which covers an edge 16, as well as an adjoining region 18, of the electrode 12. The housing 14, which is nonconductive, serves to mask or protect the edge 16 and the adjoining region 18 from an electrolyte or plating solution in which the electrode assembly 10 is immersed. The housing 14 is here in the form of an elongated, strip-like member which runs along the edge 16 of the electrode 12 and may be referred to as an edge strip.

Figure 2:
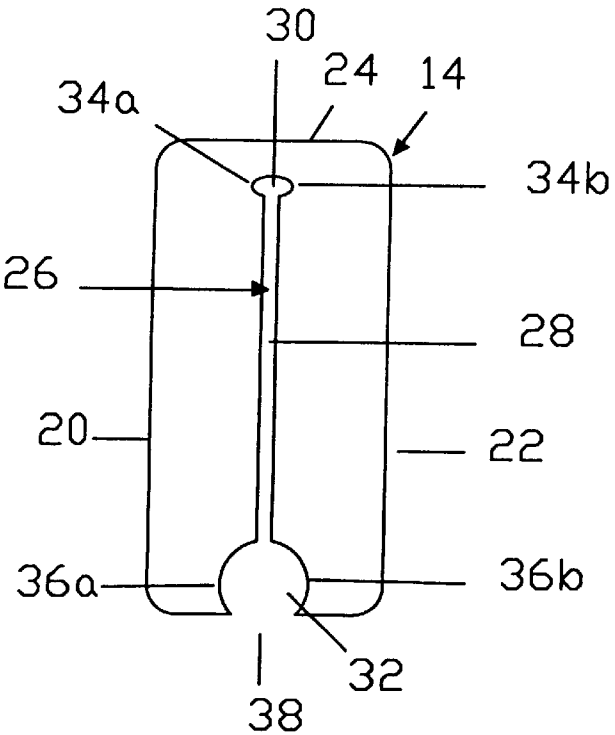
FIG. 2 is an end view of a housing constituting part of the electrode assembly of FIG. 1.

Considering FIG. 2 together with FIG. 1, the edge strip 14 is approximately U-shaped in cross section and has two legs or sections 20 and 22 which are connected to one another by a crosspiece or bridge 24. The legs 20,22 define a channel 26 which runs the length of the edge strip 14, and the channel 26 has a median portion 28, an end portion 30 adjacent to the crosspiece 24 and an end portion 32 adjacent to the free ends of the legs 20,22. The median portion 28 of the channel 26 is of generally rectangular cross section, and the channel 26 widens when moving from the median portion 28 into either the end portion 30 or the end portion 32. Thus, the channel end portion 30 includes a part-circular recess 34*a* in the leg 20 and a part-circular recess 34*b* in the leg 22. Similarly, the channel end portion 32 includes a part-circular recess 36*a* in the leg 20 and a part-circular recess 36*b* in the leg 22. The recesses 34*a*,36*a* project laterally to one side of the median channel portion 28 while the recesses 34*b*,36*b* project laterally to the opposite side of the median channel portion 28. By virtue of this design, the channel end portions 30,32 are approximately oval in cross section.

The channel 26 is closed by the crosspiece 24 at the end portion 30. On the other hand, the channel 26 has a mouth or opening 38 at the end portion 32, and the mouth 38 is bounded laterally by the free ends of the legs 20,22. The width of the mouth 38 exceeds that of the median channel portion 28.

Figure 3:
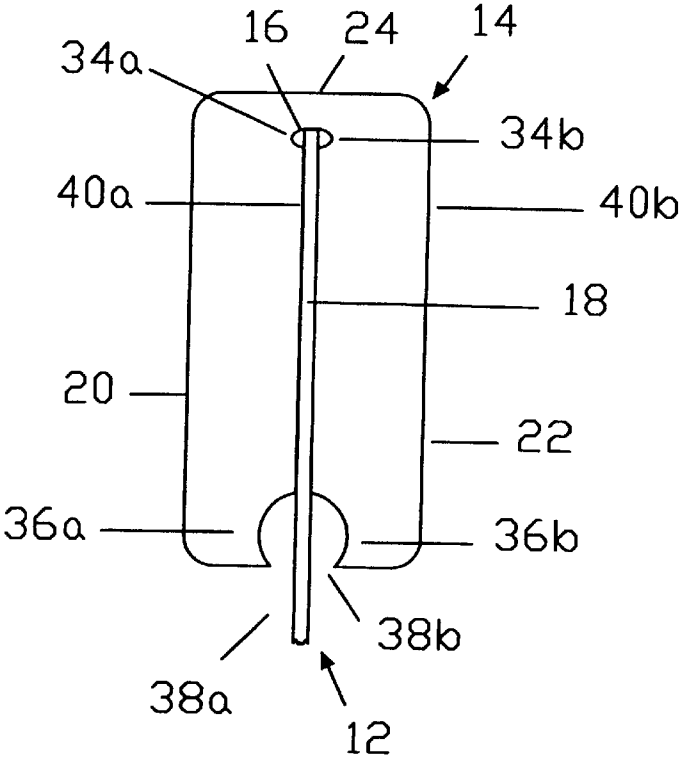
FIG. 3 is similar to FIG. 2 but shows an electrode held by the housing.

Referring to FIGS. 1 and 3, the electrode 12 passes through the mouth 38 of the channel 26, and the edge 16 and adjoining region 18 of the electrode 12 are located in the channel 26. The edge 16 abuts the crosspiece 24 of the edge strip 14 while the adjoining region 18 runs through the channel end portion 30, the median channel portion 28 and the channel end portion 32.

The electrode 12 has a thickness such that the part of the electrode 12 in the median channel portion 28 is frictionally gripped or held by the legs 20,22 of the edge strip 14. On the other hand, the thickness of the electrode 12 is less than that of the mouth 38 of the channel 26 so that slots 38*a* and 38*b* are formed between the electrode 12 and the free ends of the respective legs 20 and 22.

The electrode 12 includes a flat major surface 40*a* which faces the leg 20 of the edge strip 14 and an opposite flat major surface 40*b* which faces the leg 22 of the edge strip 14. The major surface 40*a* and the leg 20 cooperate to define a gap made up of the recess 36*a* and the slot 38*a* while the major surface 40*b* and the leg 22 cooperate to define a gap made up of the recess 36*b* and the slot 38*b*.

As illustrated in FIG. 1, a sealing element 42 is located in the gap 36*a*,38*a* while a second sealing element 44 is located in the gap 36*b*,38*b*. The sealing elements 42,44 are elongated and may be considered to constitute strips. Each of the sealing strips 42,44 runs the length of the edge strip 14 and prevents electrolyte from entering the respective gap 36*a*, 38*a* or 36*b*,38*b*. The sealing strips 42,44 are discrete or separate from the electrode 12 and the edge strip 14.

Figure 4:
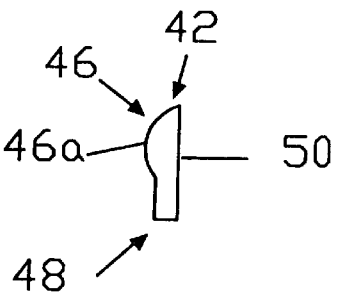
FIG. 4 is an end view of a sealing element forming part of the electrode assembly of FIG. 1.

The sealing strips 42,44 are identical and will be described with reference to FIG. 4, which shows the sealing strip 42, in conjunction with FIGS. 1 and 3.

The sealing strip 42 has opposite major sides and, as seen in cross section, includes a rounded part 46 as well as a rectangular part 48. The rounded part 46 protrudes beyond the rectangular part 48 on one of the major sides of the sealing strip 42 while the other of the major sides is provided with a flat surface 50 which lies against the major surface 40*a* of the electrode 12. The rounded part 46 is part-circular like the recess 36*a* in the edge strip 14, and the cross-sectional size of the rounded part 46 is the same or approximately the same as that of the recess 36*a*. Thus, the cross-sectional shape and dimensions of the rounded part 46 match or approximately match the cross-sectional shape and dimensions of the recess 36*a*, that is, the rounded part 46 is complementary or approximately complementary to the recess 36*a* in cross section. The rounded part 46 is formed with a part-circular surface 46*a* which lies against the part-circular surface of the recess 36*a*.

The rectangular part 48 of the sealing strip 42 extends from the rounded part 46 through the slot 38*a* of the gap 36*a*,38*a* defined by the edge strip 14 and the electrode 12. The rectangular part 48 can be eliminated, if desired.

The sealing strip 42 is elastic or resilient and can accordingly undergo elastic deformation from a contracted condition to an extended or stretched condition, and vice versa. When the sealing strip 42 is in the extended condition, the sealing strip 42 tends to return to the contracted condition. In the contracted condition, the sealing strip 42 is elastically urged against the major surface 40*a* of the electrode 12 and the part-circular surface of the recess 36*a*. Hence, the sealing strip 42 is held or anchored in the gap 36*a*,38*a* in the contracted condition of the sealing strip 42.

In the contracted condition of the sealing strip 42, the thickness of the rounded part 46 exceeds the width of the slot 38*a* forming part of the gap 36*a*,38*a*. This prevents withdrawal of the contracted sealing strip 42 from the gap 36*a*,38*a* via the slot 38*a*, even under the action of a relatively large force, and serves to enhance anchoring of the sealing strip 42 in the gap 36*a*,38*a*.

The sealing strip 42 is designed so that, as the sealing strip 42 is stretched to the extended condition, the thickness of the rounded part 46 decreases to a value equal to or less than the width of the slot 38*a*. Consequently, in the extended condition of the sealing strip 42, the sealing strip 42 can be removed from the gap 36*a*,38*a* by way of the slot 38*a* when subjected to a relatively small force which is insufficient to draw the sealing strip 42 through the slot 38*a* in the contracted condition of the strip 42.

The ability to remove the sealing strip 42 from the gap 36*a*,38*a* by stretching the sealing strip 42 makes it possible to replace the sealing strip 42, e.g., when the sealing strip 42 has deteriorated so that it can no longer form an effective seal. Inasmuch as the sealing strip 42 is discrete or separate from the electrode 12 and the edge strip 14, it is unnecessary to replace the electrode 12 and/or the edge strip 14 together with the sealing strip 42. This allows the sealing strip 42 to be replaced in an economical manner.

The leg 22 of the edge strip 14 is provided with a countersunk opening 52 which passes through the leg 22 and registers with a non-illustrated opening passing through the electrode 12. The opening 52 and the opening in the electrode 12 further register with a non-illustrated blind opening in the leg 20 of the edge strip 14. A countersunk pin 54 extends into the opening 52, the opening in the electrode 12 and the opening in the leg 20 to secure the electrode 12 in the edge strip 14.

One manner of making the electrode assembly 10 is as follows:

The edge 16 and adjoining region 18 of the electrode 12 are inserted in the channel 26 of the edge strip 14. The electrode 12 is positioned with the edge 16 abutting the crosspiece 24 of the edge strip 14. The electrode 12 is also positioned so that the opening in the electrode 12 is aligned with the opening 52 in the leg 22 and the blind opening in the leg 20. After the electrode 12 has been correctly positioned in the edge strip 14, the pin 54 is placed in the opening 52, the registering opening in the electrode 12 and the registering blind opening in the leg 20. Upon insertion of the electrode 12 in the edge strip 14, the gap

36*a*,38*a* is formed between the leg 20 of the edge strip 14 and the major surface 40*a* of the electrode 12. Similarly, the gap 36*b*,38*b* is formed between the leg 22 of the edge strip 14 and the major surface 40*b* of the electrode 12.

The sealing strip 42 is now stretched to such an extent that the thickness of the rounded part 46 decreases to a value no greater than the width of the slot 38*a*. The sealing strip 42 is positioned with the flat surface 50 thereof facing the major surface 40*a* of the electrode 12, and the rounded part 46 is passed through the slot 38*a* into the recess 36*a*. Once the rounded part 46 has entered the recess 36*a*, the sealing strip 42 is allowed to contract. As a result, the flat surface 50 of the sealing strip 42 forms a seal with the major surface 40*a* of the electrode 12 whereas the part-circular surface 46*a* of the rounded part 46 forms a seal with the surface of the recess 36*a*.

The sealing strip 44 is inserted in the gap 36*b*,38*b* in the same fashion as the sealing strip 42 is inserted in the gap 36*a*,38*a*. This completes the electrode assembly 10 which can thereupon be immersed in the electrolyte of an electrolytic cell.

The sealing strips 42,44 deteriorate over time, and deterioration is accelerated in an electrolytic cell because the electrolyte attacks the sealing strips 42,44. When the sealing strip 42 has deteriorated to such a degree that the sealing strip 42 can no longer form a proper seal, the sealing strip 42 is replaced. This may be accomplished by removing the electrode assembly 10 from the electrolyte and stretching the sealing strip 42 so that the thickness of the rounded part 46 decreases to a value which at most equals the width of the slot 38*a*. The rounded part 46 is then passed through the slot 38*a* to thereby withdraw the sealing strip 42 from the gap 36*a*,38*a*. A fresh sealing strip similar to the sealing strip 42 is now inserted in the gap 36*a*,38*a* using the insertion procedure described previously for the sealing strip 42.

The sealing strip 44 can be replaced in the same way as the sealing strip 42.

Various modifications are possible within the meaning and range of equivalence of the appended claims.

I claim:

1. An electrode assembly comprising:

a housing;

an electrode extending into said housing and defining at least one gap therewith; and a sealing element in said gap, said sealing element being discrete from said housing and said electrode, and said sealing element having a first condition in which at least one part of said sealing element is anchored in said gap and remains anchored when subjected to a predetermined force, said sealing element having a second condition in which said one part of said sealing element is removable from said gap when subjected to said predetermined force.

2. The assembly of claim 1, wherein said one part of said sealing element has a changeable thickness and the thickness of said one part in said first condition exceeds the thickness of said one part in said second condition.

3. The assembly of claim 2, wherein said one part of said sealing element is resilient.

4. The assembly of claim 1, wherein said housing has a section which cooperates with said electrode to define said one gap, said one gap including a recess in said section, and at least one part of said sealing element being located in said recess.

5. The assembly of claim 4, wherein said recess and said one part of said sealing element have at least approximately matching cross-sectional shapes and sizes.

6. The assembly of claim 5, wherein said recess and said one part of said sealing element are part-circular.

7. An electrode assembly comprising:

a housing;

an electrode extending into said housing and defining a first gap and an additional gap with said housing;

a first sealing element in said first gap, said first sealing element being discrete from said housing and said electrode; and an additional sealing element in said additional gap, said additional sealing element being discrete from said housing and said electrode.

8. A method of manipulating an electrode assembly which includes a housing, an electrode extending into said housing and defining at least one gap therewith, and a sealing element in said one gap, said method comprising the step of removing said sealing element from said one gap while said electrode extends into said housing.

9. The method of claim 8, further comprising the step of inserting another sealing element in said one gap following the removing step.

10. A method of making an electrode assembly comprising the steps of:

inserting a portion of an electrode in a housing; and inserting a sealing element between said housing and said portion following insertion of said portion in said housing.

* * * * *